US007743713B2

(12) United States Patent
Volk et al.

(10) Patent No.: US 7,743,713 B2
(45) Date of Patent: Jun. 29, 2010

(54) BAG INCLUDING LOCKABLE HANDLE

(76) Inventors: Pam Volk, 1170 W. Fork, Lake Forest, IL (US) 60045; Vincent S. Volk, 1170 W. Fork, Lake Forest, IL (US) 60045

( * ) Notice: Subject to any disclaimer, the term of this patent is extended or adjusted under 35 U.S.C. 154(b) by 1078 days.

(21) Appl. No.: 10/897,451

(22) Filed: Jul. 22, 2004

(65) Prior Publication Data

US 2006/0016531 A1 Jan. 26, 2006

(51) Int. Cl.
*B65D 85/00* (2006.01)
*A45C 13/18* (2006.01)

(52) U.S. Cl. ..... 105/102; 150/110; 150/107; 70/68; 70/67; 383/97; 190/903; 190/101

(58) Field of Classification Search ..... 70/68, 70/67; 150/102, 110, 107; 383/97; 190/101, 190/903
See application file for complete search history.

(56) References Cited

U.S. PATENT DOCUMENTS

| | | | | | |
|---|---|---|---|---|---|
| 465,450 | A * | 12/1891 | Brooke | 70/26 |
| 1,176,448 | A * | 3/1916 | Hohenstatt | 150/110 |
| 1,468,711 | A * | 9/1923 | Dwyer | 383/6 |
| 1,759,283 | A * | 5/1930 | Schmidt | 70/68 |
| 2,437,099 | A * | 3/1948 | Krupp | 150/107 |
| 4,213,314 | A * | 7/1980 | Trader | 70/68 |
| 4,792,026 | A * | 12/1988 | Dimmick et al. | 190/101 |
| 6,296,213 | B1 * | 10/2001 | Law et al. | 248/166 |
| 6,604,390 | B1 * | 8/2003 | Nooner | 70/63 |
| 6,807,832 | B1 * | 10/2004 | Jeng | 70/68 |
| 7,367,482 | B1 * | 5/2008 | Witherspoon, Jr. | 224/576 |
| 2002/0013981 | A1 | 2/2002 | Borgomanero | |
| 2002/0078719 | A1 | 6/2002 | Mitchell et al. | |
| 2003/0029207 | A1 | 2/2003 | Young | |

FOREIGN PATENT DOCUMENTS

| | | | |
|---|---|---|---|
| GB | 2390295 | * | 1/2004 |
| JP | 2003-88416 | * | 3/2003 |

OTHER PUBLICATIONS

Samsonite Triple Combination Lock Luggage Strap, http:/navigatorenterprises.site.yahoo.net/luggagelock.html, dated Aug. 6, 2004.
Strap with Combination lock buckle, 2"×80", Rainbow http:/www.greenlightoffice.com/product/displayproduct, dated Aug. 6, 2004.

* cited by examiner

*Primary Examiner*—Tri M Mai
(74) *Attorney, Agent, or Firm*—K&L Gates LLP

(57) ABSTRACT

A bag defining an interior space and an opening. The bag includes a closing member which is connected to the body. The closing member is movable between a first position, which allows access to the interior space of the body through the opening, and a second position which prevents access to the interior space of the body through the opening. The bag includes a handle and a lockable member connected to the body. The handle includes at least one removable end. The lockable member is adapted to secure and lock the closing member and the removable end of the handle to the body when the closing member is moved to the second position to protect the bag and the items contained in the bag from being taken.

3 Claims, 13 Drawing Sheets

BAG INCLUDING LOCKABLE HANDLE

BACKGROUND OF THE INVENTION

The present invention relates generally to apparatus and methods for securing bags and, more particularly, to a bag including a lockable handle.

People use several types of bags, handheld bags, handbags or containers for carrying different personal items with them to a store, the beach, the pool and other locations. For example, women use purses to carry cosmetics, wallets, checkbooks and other personal and valuable items with them. Similarly, students use backpacks to carry books, homework and other items to and from school. Travelers carry clothes, passports and other similar items with them when they travel. These bags or containers contain valuable items that the person does not want to lose or have stolen. Therefore, to ensure that the items are not being removed or stolen from the person's bags, the persons must keep the bags with them at all times. In some situations, carrying the bags at all times becomes burdensome and makes some activities almost impossible.

For example, if a person is at a relatively open area such as a pool or beach and the person has a bag such as a beach bag or purse, the person cannot leave their spot at the pool or beach without taking the bag with them for fear that the bag will be stolen or that one or more items from the bag will be stolen or removed by thieves or the like. The person must therefore carry the bag or purse with them to get food, go to the bathroom or to perform other activities such as playing volleyball. In addition, if the person wants to go in the water to swim, the person must have another person such as a spouse watch their bag while they are in the water. Otherwise, the person must place the bag as close to the water as possible to keep an eye on the bag. The additional burdens of watching the bag and carrying the bag makes carrying other items such as food trays or performing functions such as going to the bathroom more difficult.

Thieves operate quickly and discretely. Therefore, a bag that is secured and locked to an object or at least secured and locked in a closed position is a less desirable target for a thief because the thief will have to spend too much time and effort to attempt to remove the bag or to remove the items from the bag. A thief is less likely to want to draw attention to themselves by trying to cut, pry or break into a secured and locked bag to remove the bag or remove the contents of the bag.

Accordingly, it is desirable to have a container such as a handbag or bag which includes a handle that is securable and lockable to the body of the bag to simultaneously enable the bag to be secured and locked to another item or object such as a beach chair and also enable the container or bag to be secured closed so that personal items and valuable items cannot be removed from the bag. This enables the bag owners to temporarily leave the bag in a particular location without allowing thieves to easily take the bag or remove contents from the bag while the bag owner is away. The bag owner can then feel assured that the bag is safe while they perform other functions and activities.

It is therefore desirable to provide a bag or container that enables a user to secure the bag to another item.

It is also desirable to provide a bag having a handle that is securable to an object such as a chair to prevent the bag from being easily removed or stolen.

Furthermore, it is desirable to provide a bag including a handle that enables the bag to be secured and locked in a closed position to prevent unauthorized persons from opening the bag and removing personal items and valuable items from inside the bag.

It is also desirable to provide a bag having a lockable handle that includes several different types of locks.

SUMMARY OF THE INVENTION

The present invention provides a securable container such as a bag and method for securing containers such as bags, handbags, purses, luggage, beach bags, duffel bags, back packs and the like. The teachings of the present invention, however, are not dependent upon the handbags or bags being any particular type of bag, container or any other item which is used to carry personal items from one location to another location. The bags described herein are configured to securely hold one or more personal items while preventing the bag and any of the personal and valuable items contained inside the bag from being removed when the bag is secured to an object in a designated location.

In an embodiment, the a bag of the present invention is provided where the bag includes a body defining an interior space and an opening. A closing member is connected to the body, where the closing member is movable to a first position to allow access to the interior space through the opening and to a second position to prevent access to the interior space through the opening. The bag also includes a handle connected to the body, where the handle has a least one removable end. The bag includes a securing member connected to the removable end of the handle and a lockable member connected to the body. The securing member engages the closing member and the lockable member to simultaneously lock the closing member and the securing member to the body when the closing member is in the second position.

In an embodiment, the lockable member defines an opening, where the opening is sized to receive a key which locks and unlocks the lockable member.

In another embodiment, the body includes a front wall, a rear wall side walls and a bottom wall which are connected together.

In an embodiment, at least one cover is attached to at least one of the walls.

In another embodiment, the lockable member includes a suitable combination lock.

In an embodiment, the removable end of the handle includes a plurality of securing members each adapted to be received by the lockable member, where at least one of the securing members is insertable through the closing member to secure and lock the closing member and the removable end of the handle to the lockable member.

In another embodiment, the closing member includes a zipper having a plurality of opposing mating dividers connected to the body and a zipper pull movably connected to each of the plurality of dividers, the zipper pull including a tab, wherein the tab enables the zipper pull to be moved between the first position and the second position.

In an embodiment, at least a portion of at least one of the body and the handle includes a reinforcer.

In another embodiment, at least a portion of the reinforcer includes a metal.

In an embodiment, at least a portion of the reinforcer includes a fabric material.

In an embodiment, a suitable pad lock is attachable to the closing member, removable end and the body.

In an embodiment, the lockable member further includes a removable lock that is attachable to the handle, the closing member and the body.

A bag of another embodiment of the present invention is provided where the bag includes a body defining an interior space and a cover connected to the body. The cover is movable between an open position and a closed position. The open position allows access to the interior space of the body, and the closed position prevents access to the interior space of the body. The bag also includes a handle having at least one removable end and a securing member connected to the removable end of the handle. The bag includes a lock integrally connected to the body, where the securing member is secured to the cover and the lock to simultaneously secure and lock the cover in the closed position.

In an embodiment, the lock defines a keyhole adapted to receive a key.

In another embodiment, the lock includes a suitable combination lock.

In an embodiment, a suitable pad lock is attachable to the closing member, removable end and the body.

In an embodiment, at least a portion of at least one of the cover and the body includes a reinforcer.

In another embodiment, at least a portion of the reinforcer includes a metal.

In an embodiment, at least a portion of the reinforcer includes a fabric material.

In an embodiment, the lock further includes a removable lock that is attachable to the handle, the closing member and the body.

A method of securing and locking a bag is provided where the method includes the steps of providing a body defining an interior space and an opening, where the body includes a handle having two ends and a lockable member. At least one of the ends is removable from the body and the lockable member is adapted to receive the removable end of the handle. The next step includes moving a closing member from an open position to a closed position to prevent access to the interior space through the opening, where the closing member is adapted to receive at least a portion of the removable end of the handle. The next step includes locking the closing member and the removable end of the handle to the lockable member.

In an embodiment, the method includes positioning the removable end of the handle about an object before locking the securing member and the removable end of the handle to the lockable member.

In another embodiment, the method includes attaching a reinforcer to at least a portion of at least one of the handle and the body.

In an embodiment, the method includes locking and unlocking the closing member and the removable end of the handle to and from the lockable member using a key insertable into the lockable member.

In another embodiment, the method includes locking and unlocking the closing member and the removable end of the handle to and from the lockable member using a combination settable on the lockable member.

In a further embodiment, the method includes locking and unlocking the closing member and the removable end of the handle to and from the lockable member using a padlock.

Another embodiment of a method of securing and locking a bag according to the present invention is provided where the method includes the steps of comprising providing a body defining an interior space, where the body includes a handle with at least one removable end and a zipper including a pull which is movable between an open position and a closed position. The pull includes a tab defining an opening adapted to receive the removable end of the handle, where the open position allows access the interior space of the body, and the closed position prevents access the interior space of the body. The next steps include moving the pull to the closed position and inserting a securing member connected to the removable end of the handle through the opening of the tab and into a lockable member attached to the body. The next step includes locking the pull and the securing member to the lockable member.

In an embodiment, the method includes the step of locking the removable end of the handle to the lockable member includes inserting a key into the lockable member and moving the key to and from a designated position to lock and unlock the removable end of the handle to the lockable member.

In another embodiment, the method includes locking the removable end of the handle to the lockable member includes adjusting at least one dial having indicia to a designated position on the lockable member to lock and unlock the removable end of the handle to and from the lockable member.

It is therefore an advantage of the present invention to provide a container such as a bag which is securable and lockable so that the bag cannot be opened to remove items from the bag.

It is another advantage of the present invention to provide a bag which is securable and lockable to another object to prevent the bag from being stolen and to prevent items contained in the bag from being stolen.

It is a further advantage of the present invention to provide a bag that is simultaneously securable and lockable in a closed position and to an object so that owner of the bag can temporarily leave the bag without items in the bag or the bag itself being stolen.

Additional features and advantages of the present invention are described in, and will be apparent from, the following Detailed Description of the Invention and the figures.

DETAILED DESCRIPTION OF THE INVENTION

The present invention provides an apparatus and method for securing different types of containers such as handbags or bags and specifically for securing the handles and/or zippers of such bags. The present invention may be employed to secure a strap, handle or other carrying device of a bag to the body of the bag to prevent the strap or handle from being removed from the bag or to prevent the bag from being opened and/or removed or stolen from a particular location. For example, the strap or handle can be secured to the body of the bag through the zipper or other closing member to prevent the zipper from being opened to gain access to the contents of the bag. It should be appreciated that the present invention may be used to secure any type of handheld bag or other type of bag such as purses, beach bags, tool bags, backpacks, luggage and the like.

The handle or strap may also be attached around and secured and locked to a relatively stationary object such as the arm of a chair or a fence, and then through the zipper pull or tab of a zipper to secure the bag to the chair or fence and also secure the pull in a closed position. This enables the bag's owner to temporarily secure the bag and specifically, the contents of the bag so that the bag owner can temporarily leave the bag at that location. For example, a bag owner may secure the bag to the arm of a beach chair and to leave the beach to go swimming, go to the bathroom, get food or perform some other activity. In another example, the bag can be secured to the handle of a stroller when in a crowded area to prevent thieves from snatching the bag or taking items out of the bag such as the bag owner's wallet or checkbook when the owner is not looking. The present invention therefore enables users to secure their bags to a relatively immovable object such as a chair at a particular location or to movable objects such as strollers or shopping carts so that the user does not have to constantly keep an eye on the bag and so the user can leave the bag temporarily to perform other activities without having the burden of carrying their bag with them at all times.

Figure 1:
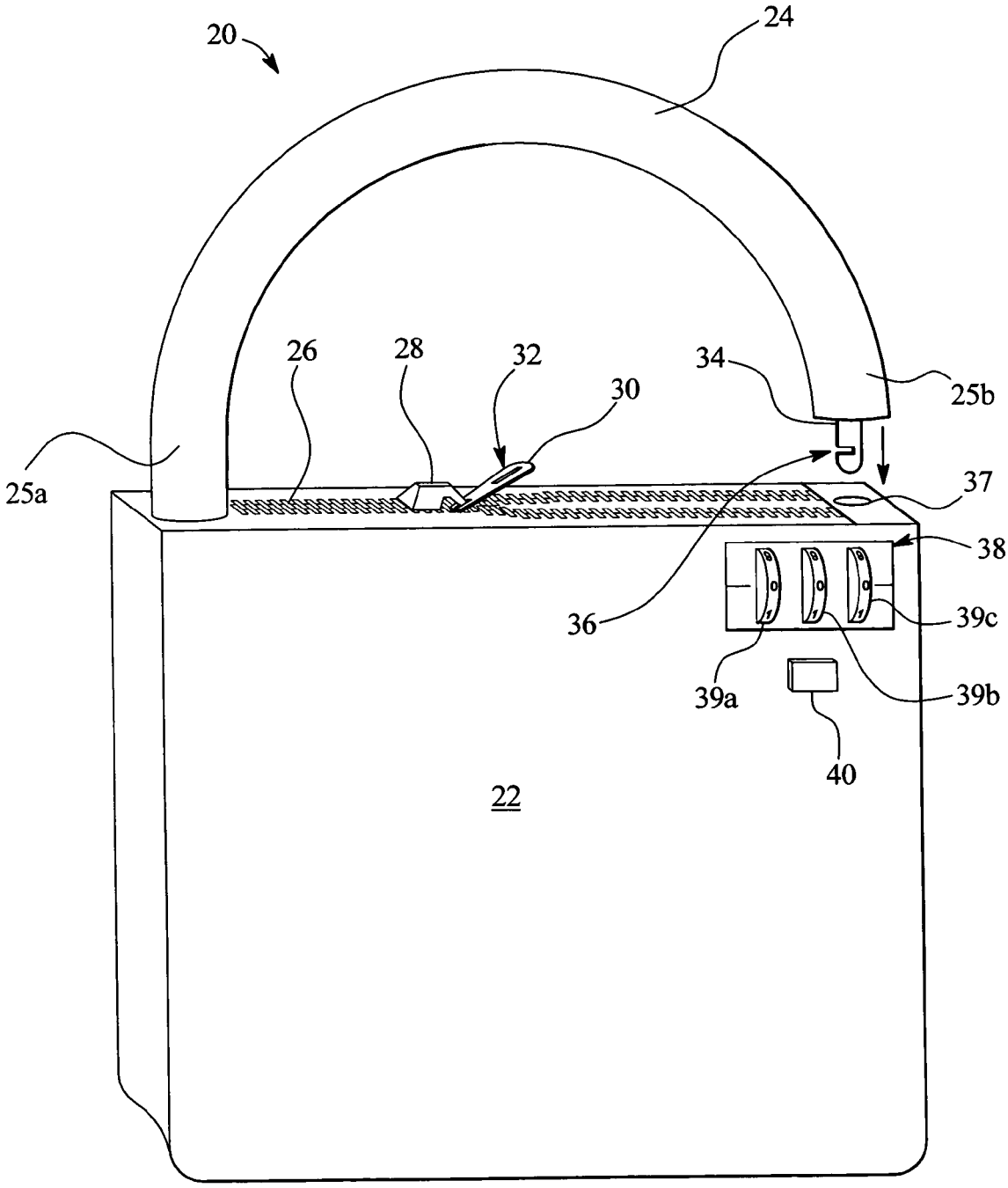
FIG. 1 illustrates a front perspective view of one embodiment of the bag of the present invention.
Figure 2:
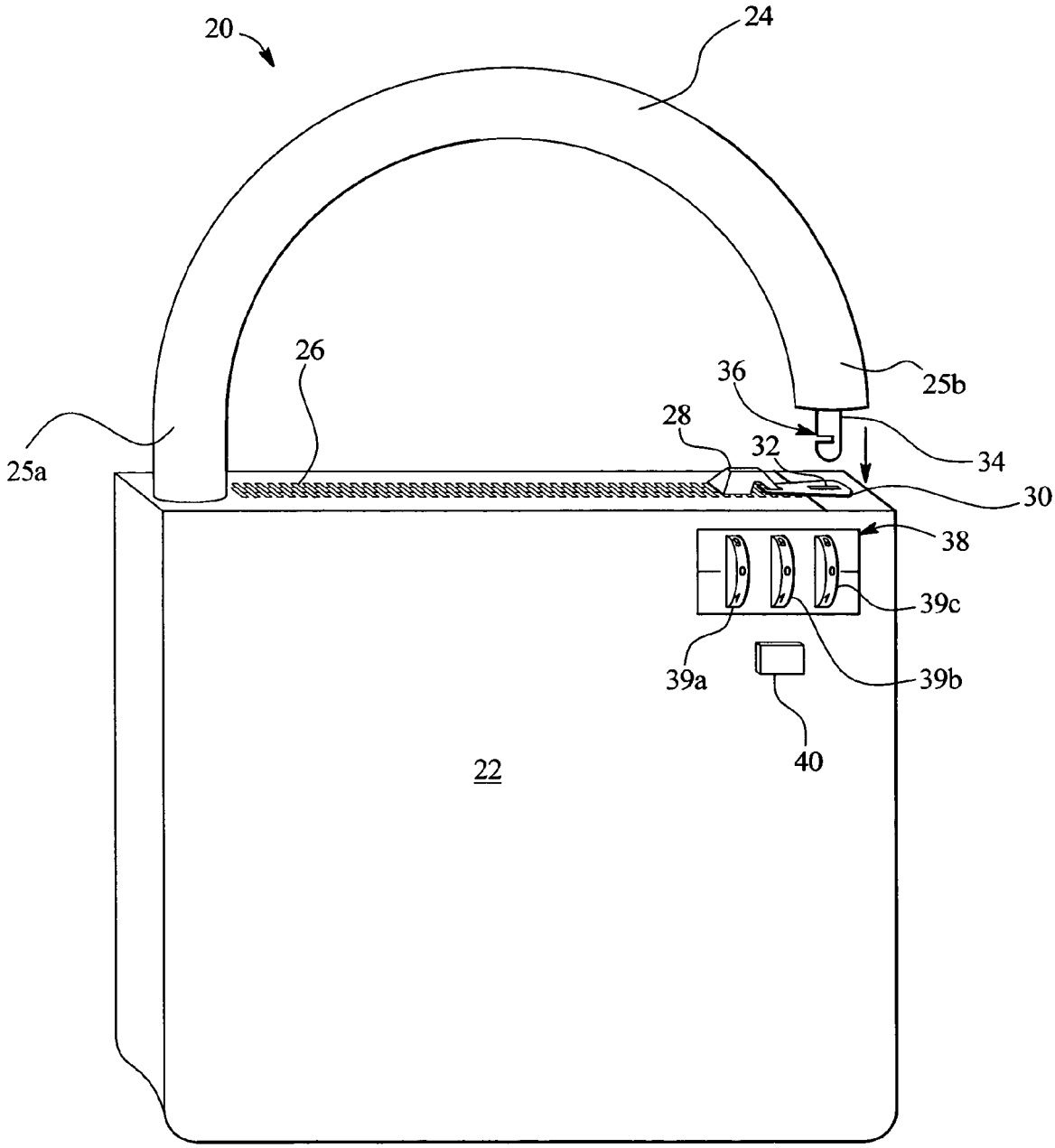
FIG. 2 illustrates a front perspective view of the embodiment of FIG. 1 where the strap is secured through the zipper to the body of the bag.
Figure 3:
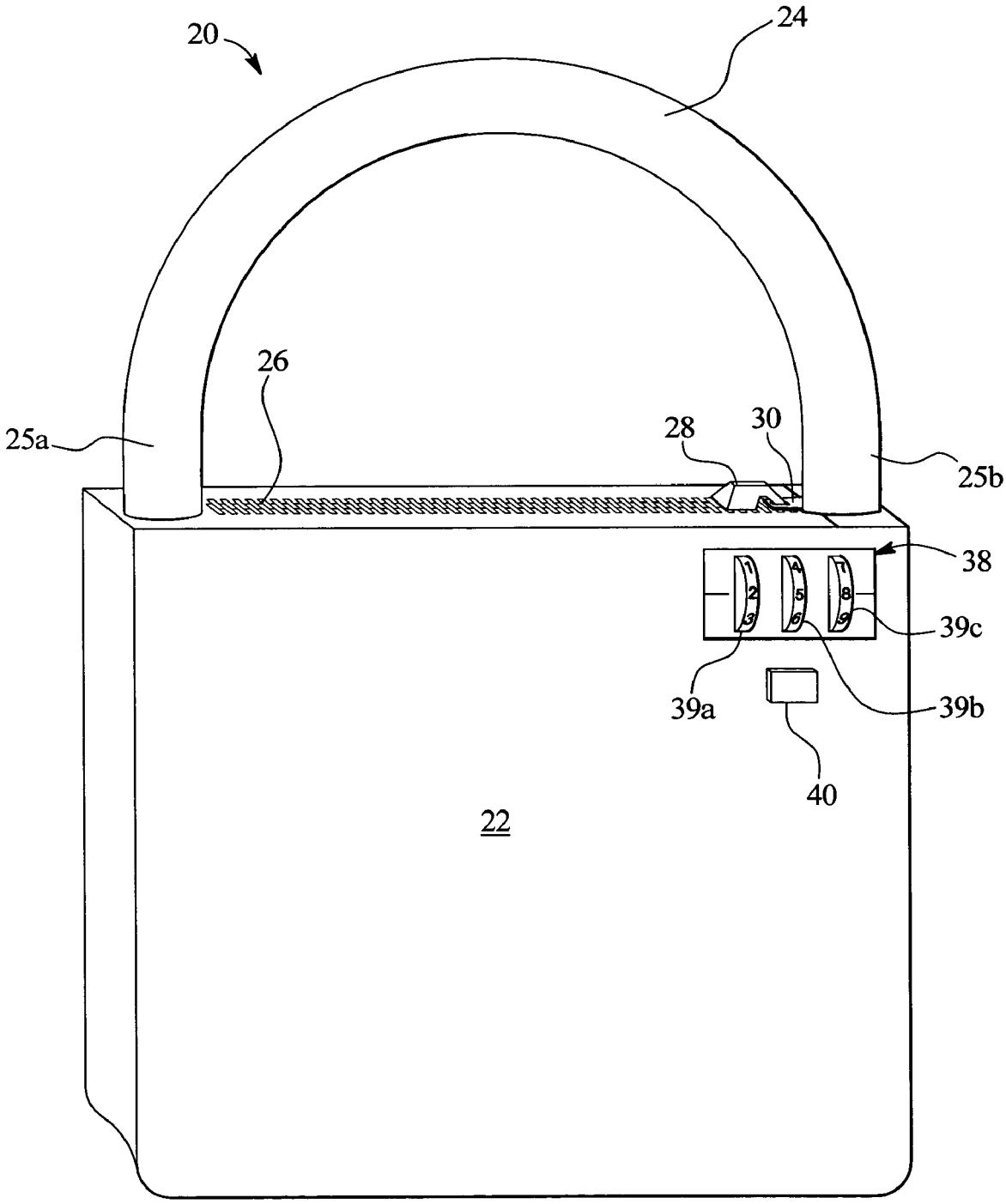
FIG. 3 illustrates a front perspective view of the embodiment of FIG. 1 where the end of the strap is locked to the body of the bag.

Referring now to FIGS. 1 to 3, one embodiment of a securable and lockable container of the present invention is generally illustrated by handbag or bag 20. Bag 20 includes a body 22 and a strap or handle 24 having two ends 25*a* and 25*b*. In an embodiment, the end 25*a* of the handle 24 is connected to the body 22. The end 25*a* may be integrally formed with the body 22 or connected using any suitable attachment method. It should appreciated that either end 25*a* or 25*b* may be secured or attached to the body 22. In this embodiment, end 25*b* is removably secured to the body 22 as described in more detail below. Bag 20 also includes a closing member such as a zipper 26 having a zipper pull 28. A tab 30 is connected to the pull 28 as shown in FIG. 1 and enables a user to grab and hold the tab to pull the tab and the zipper pull 28 along the zipper 26 to open and close the bag.

The end 25*b* of the handle 24 includes a securing member such as post 34 having a slot 36 which is connected to or integrally formed with end 25*b*. The slot 36 engages a corresponding surface in a receptacle 37 described below. The post 34 may be any suitable post such as a metal post or a post made out of any other suitable material. Preferably, the post 34 is made of a material which cannot be easily cut, severed, broken or removed from the handle 24. In an embodiment, the post 34 is sized to fit through an opening 32 defined by the handle or tab 30 of the zipper pull 28. Specifically, the zipper pull is pulled along the zipper 26 until the tab 30 is at one end of the bag which is adjacent to where the end 25*b* of the handle or strap 24 is secured to the body 22. A lockable member or lock 38 is attached to a surface of the body 22 of the bag 20 and includes a receptacle or other opening for receiving the post 34. The post 34 is inserted through the opening 32 of tab 30 and into the receptacle 37 or other opening of the lock 38 to simultaneously secure and lock the tab 30 and the post 34 (which is attached to the removable end of the handle) to the body 22. In an embodiment shown in FIG. 1, a combination lock including dials 39*a*, 39*b* and 39*c* is used to secure and lock the post 34 to the body 22. It should be appreciated that any suitable lockable member or lock may be used to secure and lock the end 25*b* of the handle 24 and the closing member to the body 22. A release tab or lever 40 is movably connected to the body of the bag. The release tab 40 is moved upward or downward to release the post 34 from the receptacle 37. The release tab 40 causes the receptacle to hold or secure the post 34 to the body and thereby the handle 24 to the body 22 when the lockable member 37 is in the locked or unlocked position. It should be appreciated that the release tab 40 may be any suitable tab or lever and may move in any suitable direction to release the post 34 from the receptacle 37.

As shown in FIG. 2, the post 34 is inserted into and through the opening 32 of tab 30 of the zipper pull. The post 34 is inserted through the opening 32 until the post cannot be inserted any further into the receptacle 37 associated with the lock 38. In an embodiment, each of the dials 39*a*, 39*b* and 39*c* of the lockable member of combination lock 38 include indicia such as symbols or numbers. In this embodiment, when each of the dials are set to 0-0-0, as shown in FIG. 1, the post 34 is not locked to the body 22. When the numbers on the dials 39*a*, 39*b* and 39*c* are set to any other combination such as 2-5-8 shown in FIG. 3 (which is not a designated unlocking combination), the post 34 is locked to the body 22. It should be appreciated that any suitable combination of indicia or symbols may be used to release or lock the post 34 to the body 22. Thus, in this embodiment, a user moves or rotates the dials 39*a*, 39*b* and 39*c* to scramble or otherwise hide the designated unlocking or release combination and thereby lock the post 34 to the body 22 after the post 34 is inserted into the receptacle 37 of the body 22. To release the post 36 from the body 22, the user moves or rotates the dials 39*a*, 39*b* and 39*c* to the designated unlocking combination (i.e., a combination including three numbers which the user will remember) to unlock the post 34 from the body 22. The user then presses or pushes the release lever or tab 40 to release the handle from the body. It should be appreciated that the dials 39*a*, 39*b* and 39*c* of the combination lock 38 may include any suitable symbols, indicia, letters, numbers or any other suitable symbols.

In an alternative embodiment, the lockable member is connected to the removable end 25*b* of the handle. The lockable member automatically locks the closing member and post to the body of the bag when the lockable member the post is inserted into a receptacle or similar opening defined by the body of the bag. The removable end of the handle and the closing member are unlocked from the body by unlocking the lockable member as described above. It should be appreciated that the lockable member may be connected to any suitable portion of the body of the bag or the handle or other part of the bag which enables the removable end of the handle and the closing member to be secured and locked to the body.

In one embodiment, the post 34 and closing member are automatically locked to the lockable member or lock when the post is inserted into the lock. In this embodiment, the post and closing member are unlocked using one of the methods described above. By automatically locking the post and closing member to the body when the post is inserted into and secured to the lock, the present invention enables a user to always securely lock their bag before they leave it at a location. This embodiment prevents a user from accidentally or inadvertently forgetting to lock the bag.

In one example, a user takes their bag to a beach. The user wants to go swimming but does not want to leave the bag unattended. Instead of searching for a locker, which could be far away, or worrying about the bag, the user removes the end 25*b* of the handle 24 from the body of the bag and loops the end 25*b* around the arm of their beach chair so that ends 25*a* and 25*b* are on opposite sides of the arm of the chair. The end 25*b* is then simultaneously secured and locked to the closing member and the lock connected to the body 22 of the bag the manner described above. This method therefore secures and locks the bag 20 to the chair and also secures the bag in a closed position to prevent the bag from being opened while the bag is secured to the chair. It also prevents the bag from being easily stolen. The user can now leave the bag locked to the chair to go swimming without having to carry the entire bag with them to the water or without having to constantly watch the bag and worry about whether the bag or the contents of the bag will be stolen.

Figure 4:
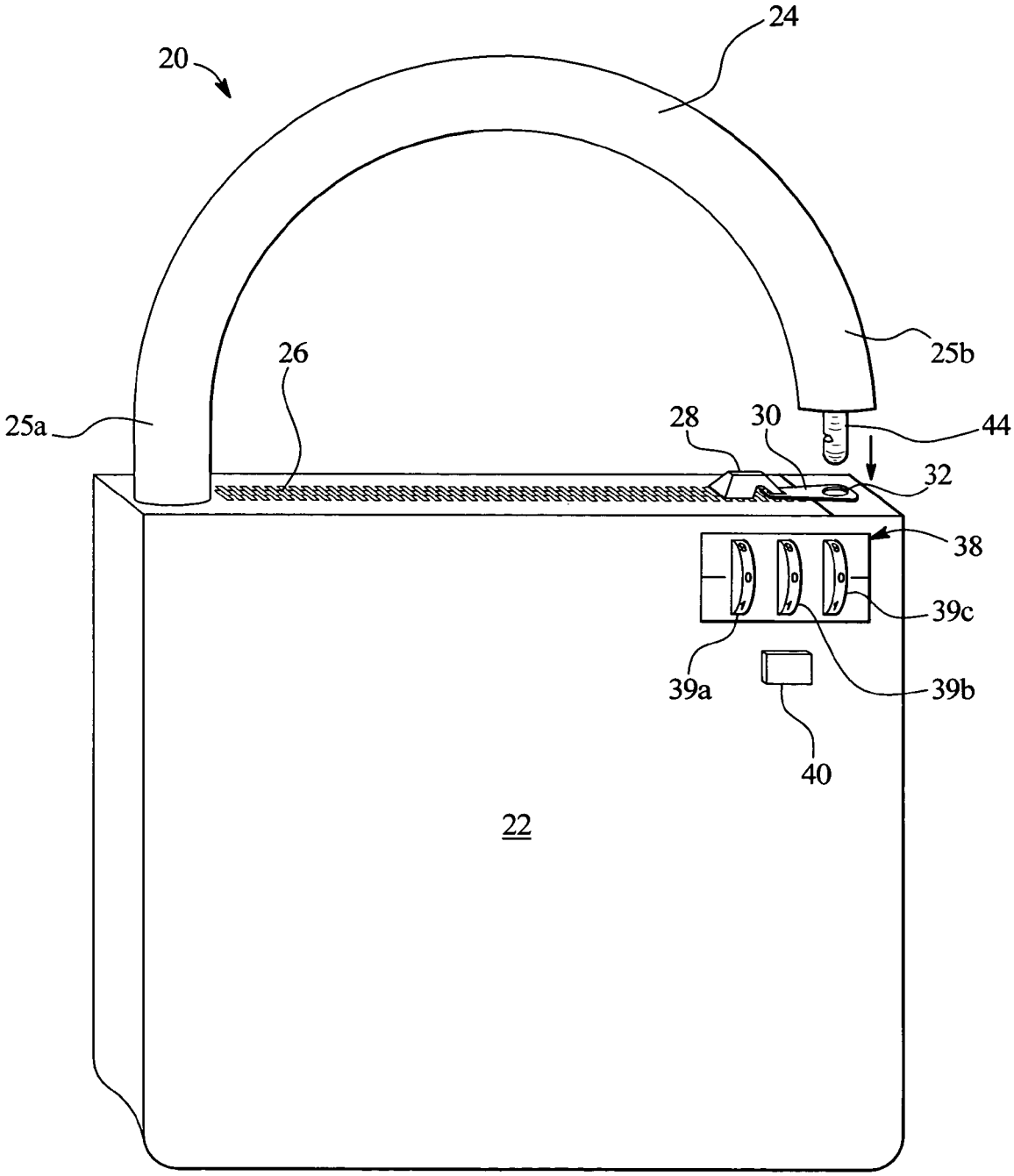
FIG. 4 illustrates a front perspective view of another embodiment of the bag of the present invention.

Referring to FIG. 4, other types of closing members or closing devices may be employed by the present invention. For example, a round post 44 may be attached to the end 25*b* of the handle 24 and inserted through a corresponding round receptacle or opening 32 of the tab 30 and to the combination lock 38 having settable dials 39*a*, 39*b* and 39*c* to secure the handle 24 to the body 22 of the bag. The release tab 40 is moved to release the post 44 from the body 22. It should be appreciated that any suitable post, closing member (i.e., zipper), or other suitable closing devices or methods may be employed by the present invention.

Figure 5:
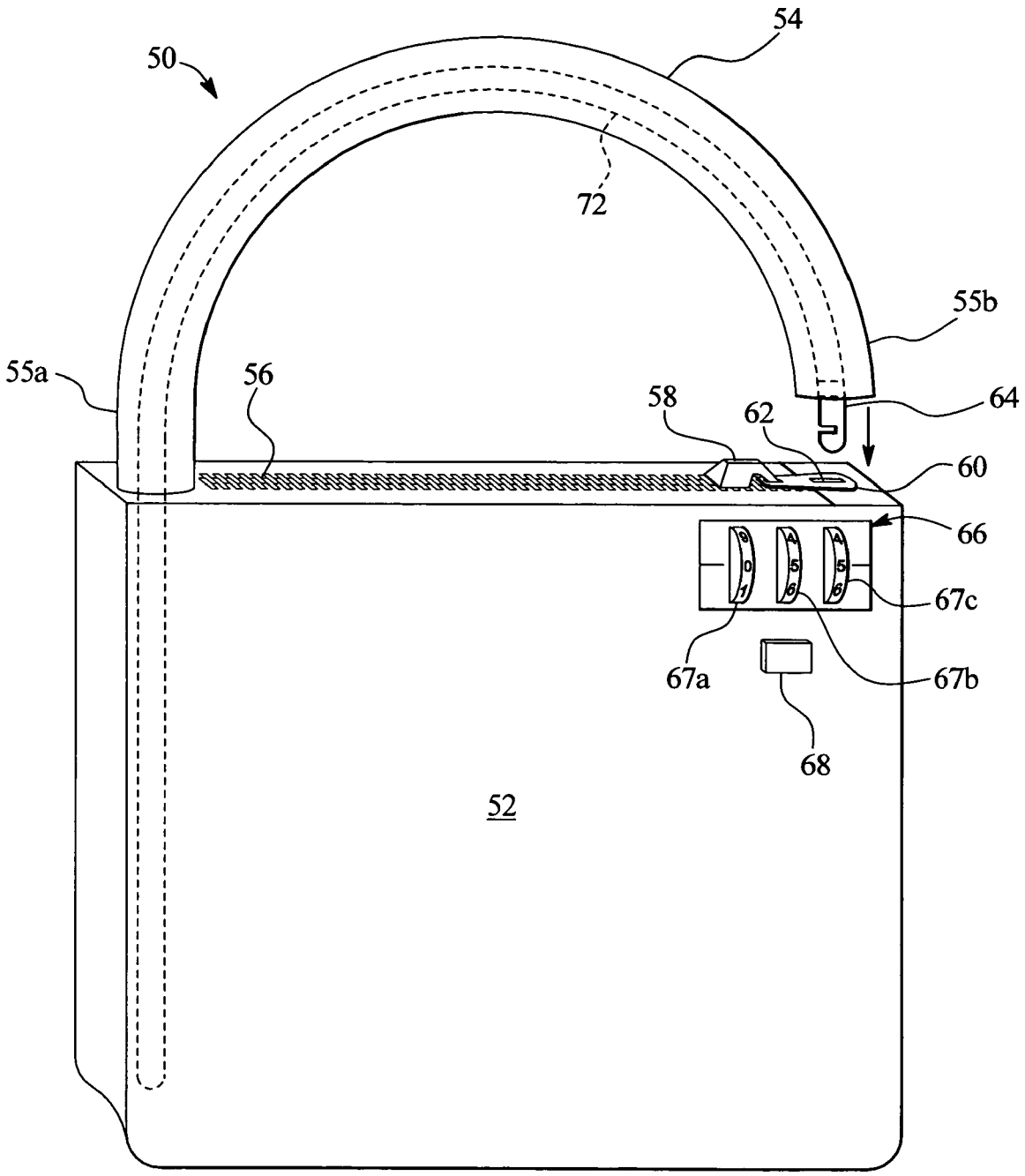
FIG. 5 illustrates a front perspective view of a further embodiment of the bag of the present invention.

Referring now to FIG. 5, another embodiment of the present invention is illustrated as bag 50 where the bag includes a reinforcing mechanism, reinforcing member or reinforcer 72 such as a metal wire or the like that adds to the security of the bag. In FIG. 5, the bag 50 includes a body 52 and a handle or strap 54 which has two ends 55*a* and 55*b*. The end 55*a* is connected to the body 52 using any suitable attachment method. The end 55*b* of the handle 54 is removably secured to the body 52 to enable a user to secure and lock the bag to another object or item such as a chair as describe above. In this embodiment, the end 55*b* of the handle 54 includes a securing member or post 64 which is inserted through an opening 62 of the zipper pull 58 to secure the end 55*b* and the zipper pull 58 in place. In particular, the post 64 is inserted through the opening 62 and into the lockable member or combination lock 66 having settable dials 67*a*, 67*b* and 67*c*. A release lever or tab 68 secures and releases the post 64 from the body 52. The post 64 (i.e., the removable end 55*b*) and the zipper pull 58 are simultaneously secured to the lock 66. The dials 67*a*, 67*b* and 67*c* of the combination lock are moved to lock post 64 in place. Alternatively, the post and zipper pull are simultaneously and automatically locked to the combination lock 66. This secures the handle 54 in place as well as prevents the zipper pull 58 from being moved to open zipper 56 and thereby gain access to the contents in the bag 50.

In the illustrated embodiment, the bag 50 also includes a reinforcing member or reinforcer such as wire 72 which is positioned within or otherwise connected or attached to at least a portion of the handle 54 and at least a portion of the body 52. The wire 72 is preferably made of a suitable material such as a suitable metal or a strong fiber or fabric material which is difficult to cut, rip, sever or break. This prevents the bag and specifically the secured handle 54 from being cut, broken or severed in any way to remove the bag 50 from the object that it is secured to. The reinforcer 72 thereby makes cutting or otherwise removing the bag away from the object it is secured and locked to much more difficult. This embodiment further prevents a thief from quickly and easily taking the bag or from removing the contents of the bag. It should be appreciated that the reinforcer may include any suitable wire, fabric, or other lining device or material. The reinforcer 72 may be positioned in, manufactured or otherwise connected to a portion or all of the surfaces of the body 52 of bag 50. For example, the reinforcer 72 may be sewn into or otherwise connected to all of the sides or surfaces of the body 52 to prevent the body 52 from being severed or otherwise cut to remove the bag from an object or to gain access to the contents in the bag 50. In another embodiment, a substantial portion of the walls of the body 52 are lined with a suitable reinforcing material to further prevent unauthorized access into the bag. It should be appreciated that any suitable portion of the body 52 or the handle 54 may include the reinforcing member 72 or a reinforcing material.

Figure 6:
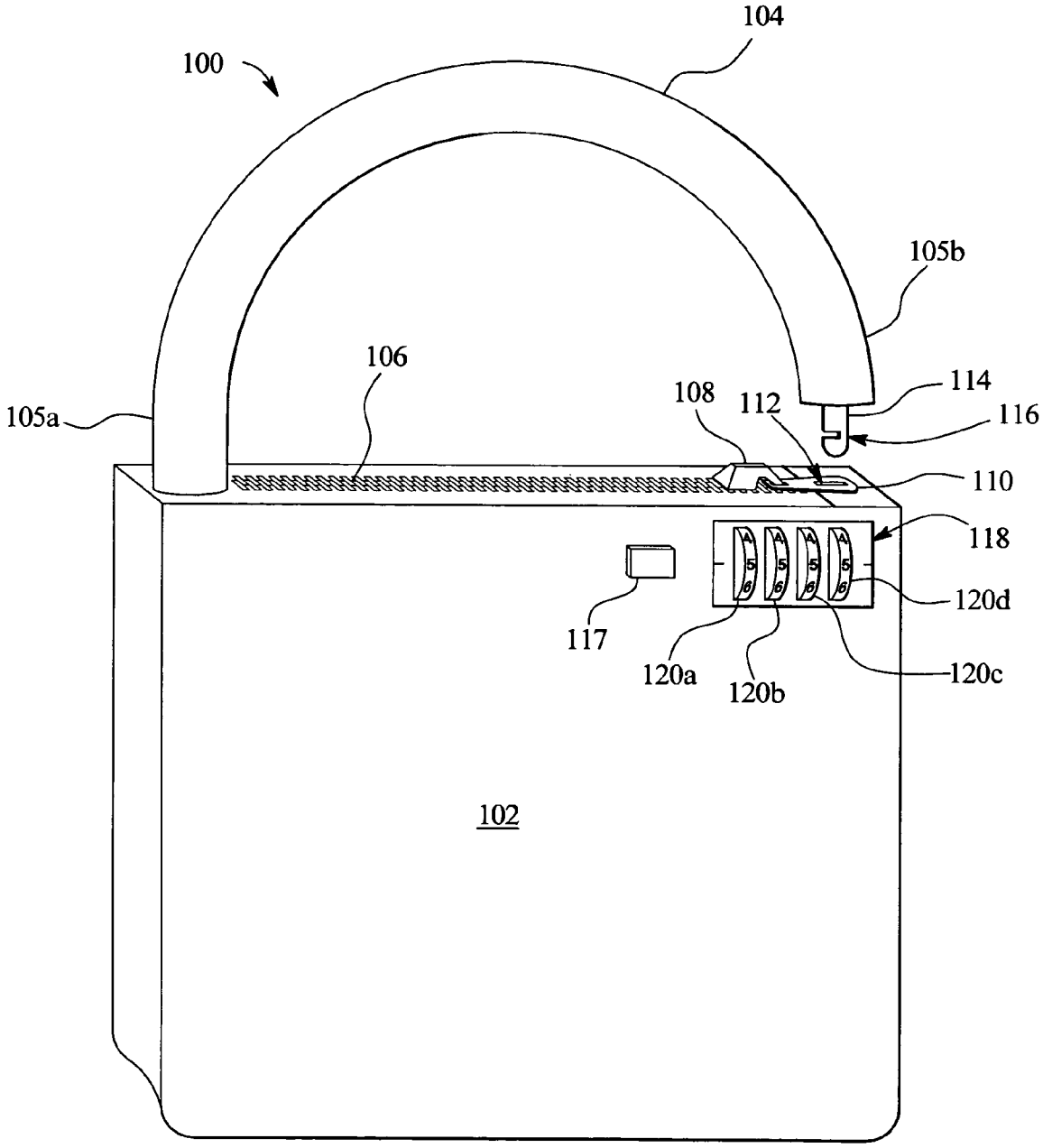
FIG. 6 illustrates a front perspective view of another embodiment of the bag of the present invention where the bag includes a suitable combination lock.

Referring to FIG. 6, another embodiment of the bag of the present invention is generally illustrated as bag 100. Bag 100 includes a body 102 and a handle 104 including ends 105*a* and 105*b*. One end of the handle 104 such as end 105*a* is secured to the body 102 as described above. The end 105*b* includes a post 114 which is secured through opening 112 defined by tab 110 of zipper pull 108 to secure the zipper pull 108 in place. This secures zipper 106 in a closed position. In this embodiment, the lockable member or lock 118 is a suitable combination lock which enables a user to set a designated combination to release the post 114 from the lock. In an embodiment, the combination lock includes four rotatable devices or dials 120*a*, 120*b*, 120*c* and 120*d*. Each of the dials 120*a*, 120*b*, 120*c* and 120*d* include different indicia or symbols such as letters or numbers which combine to form the combination. The user sets the combination using the dials 120*a*, 120*b*, 120*c* and 120*d* then rotates or moves the dials to scramble or hide the designated unlocking combination and lock the post 114 to the lock mechanism or combination lock 118. When the user desires to release the post 114 from the lock 118, the user turns or moves at least one of the dials 120*a*, 120*b*, 120*c* and 120*d* to indicate the designated unlocking combination. It should be appreciated that any suitable number of dials and/or combinations of indicia may be employed. Release tab 117 is moved to release the post 114 from the body 102 when the post 114 is unlocked.

Figure 7:
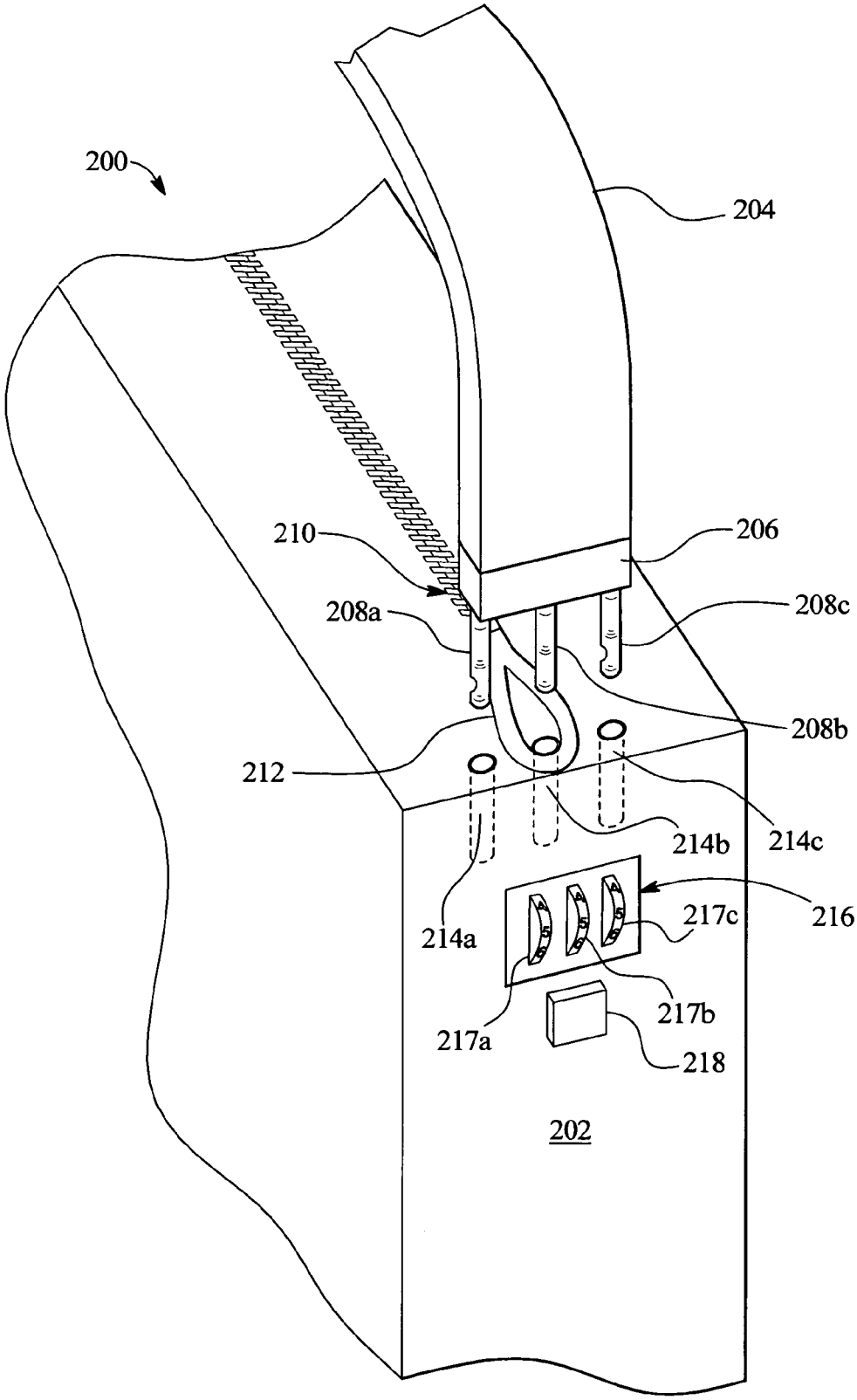
FIG. 7 illustrates a front perspective view of a further embodiment of the bag of the present invention where the bag includes a plurality of securing members.

Referring now to FIG. 7, another embodiment of the bag of the present invention is generally illustrated as bag 200. The bag 200 includes the body 202 and a handle 204. The handle 204 includes a three securing members or posts 206. Specifically, the securing members 206 include prongs or extenders 208*a*, 208*b* and 208*c*. The securing members and specifically, the prongs are made of any suitable material such as metal. The body 202 includes a number of receptacles such as receptacles 214*a*, 214*b* and 214*c* which correspond in size and shape to extenders or prongs 208*a*, 208*b* and 208*c* to receive the prongs. In an embodiment the prongs 208*a*, 208*b* and 208*c* are positioned above and adjacent to the receptacles 214*a*, 214*b* and 214*c* and are inserted into the receptacles. At least one of the prongs such as prong 208*b* is inserted through the opening 213 defined by tab 212 of zipper pull 210 to secure the zipper pull in place. The prongs 208*a*, 208*b* and 208*c* are snap-fit or otherwise positioned in receptacles 214*a*, 214*b* and 214*c* and secured in the receptacles using any type of securing mechanism or lock. A release lever 218 is movably connected to the body 202 and is pressed or otherwise activated to release the prongs 208*a*, 208*b* and 208*c* from the receptacles 214*a*, 214*b* and 214*c*. When the prongs 208*a*, 208*b* and 208*c* are inserted into the receptacles 214*a*, 214*b* and 214*c*, the dials 217*a*, 217*b* and 217*c* are moved to hide the designated combination and lock the prongs to the body 202. The three prong securing member 206 provides another apparatus and method for securing the handle 204 to the body 202 and thereby enhances the security of the bag.

Figure 8:
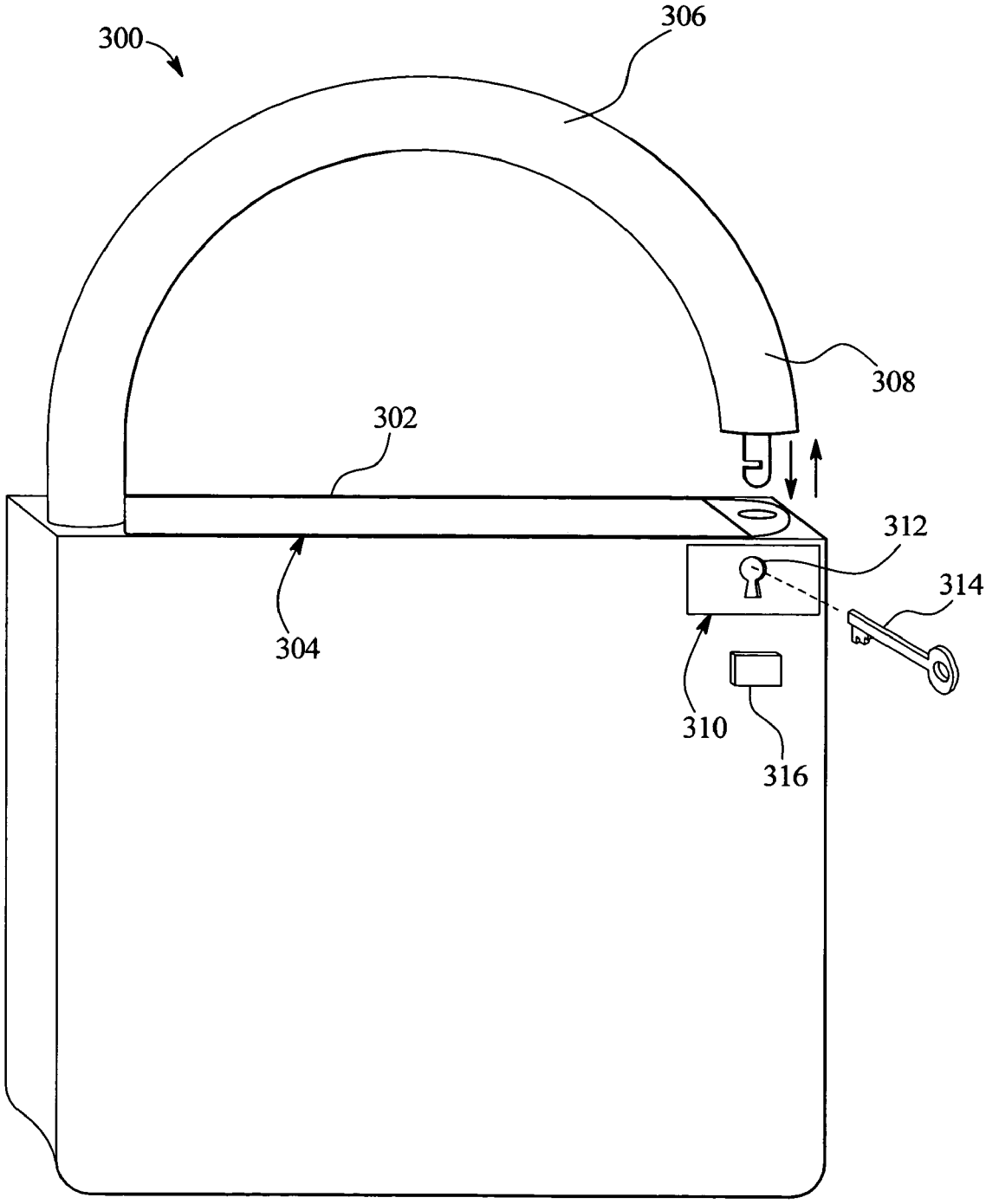
FIG. 8 illustrates a front perspective view of another embodiment of the bag of the present invention where the bag includes a securable cover.

Referring now to FIG. 8, in another embodiment, a bag 300 includes a flap or cover 302 which covers the opening 304 of the bag and is secured adjacent to the removable end 308 of the handle 306 and the lock 310. The end of the handle can then be inserted through a corresponding opening defined by the end of the flap 302 to secure the end 308 of the handle and the flap 302 to the lock 310. It should be appreciated that the flap or cover may be any suitable type of flap or cover used to cover the opening of the bag to prevent the contents of the bag from being stolen.

In a further embodiment, the lockable member includes a key-type lock 310 which defines an opening or keyhole 312. The opening or keyhole 312 is formed into a suitable size and shape to receive a key 314. In this embodiment, the handle 306 is secured to the body of the bag by inserting the post into the receptacle. In one aspect of this embodiment, the post is automatically locked to the body when the post is fully inserted into the receptacle. In another aspect of this embodiment, the post is inserted into the receptacle and then the key is turned a designated distance to lock the post to the body of the bag. To release the post from the body, the key 314 is inserted into the opening 312 and turned in one direction or the other. Then, the release tab or lever 316 is moved to release the post from the receptacle defined by the body of the bag.

Figure 9:
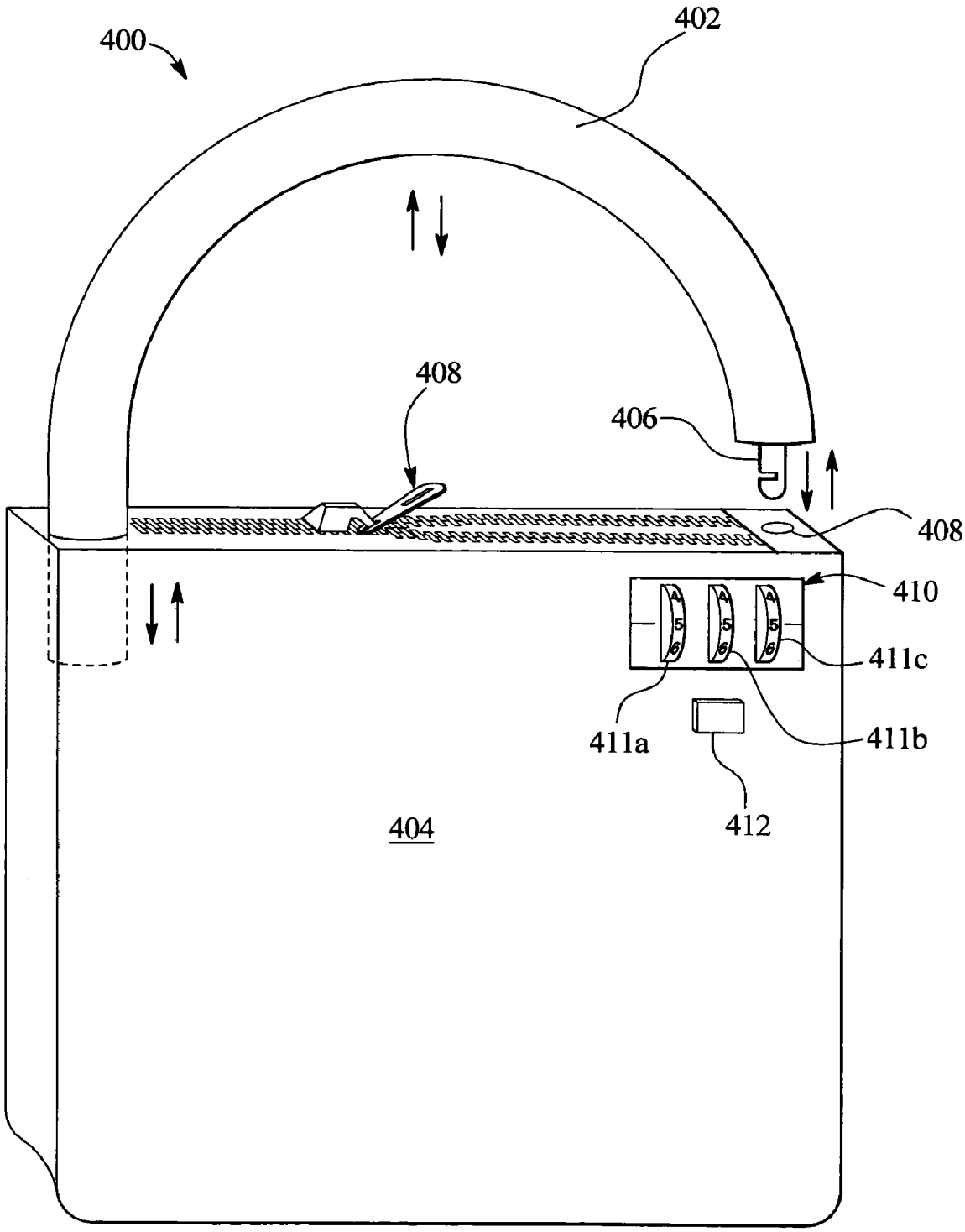
FIG. 9 illustrates a front perspective view of a further embodiment of the bag of the present invention where the bag includes a integral handle which moves upward and downward in the body of the bag to secure and lock the handle to the body.

Referring now to FIG. 9, in a further embodiment, a bag 400 includes a handle 402 which is a generally u-shaped handle. The handle is a single solid part or component such as a metal handle which moves or slides upward and downward within the body 404 of the bag as shown. To secure and lock the handle 402 to the body 404 of the bag, a user pushes down on the handle 402 to insert the securing member 406 through the zipper pull 408 and to the lock 410. To release the handle 402, the user unlocks the securing member 406 from the combination lock 410 by moving dials 411*a*, 411*b* and 411*c* to the designated combination. The user then moves the release tab 412 to release the post from the body of the bag. Then, the user lifts or pushes upward on the handle 402 to move the handle away from the body. The handle 402 can then be re-engaged or moved downward to re-engage the lock to secure the handle in place to carry the bag. It should be appreciated that handle can be manufactured and made of any material such as a suitable metal or the like.

Figure 10:
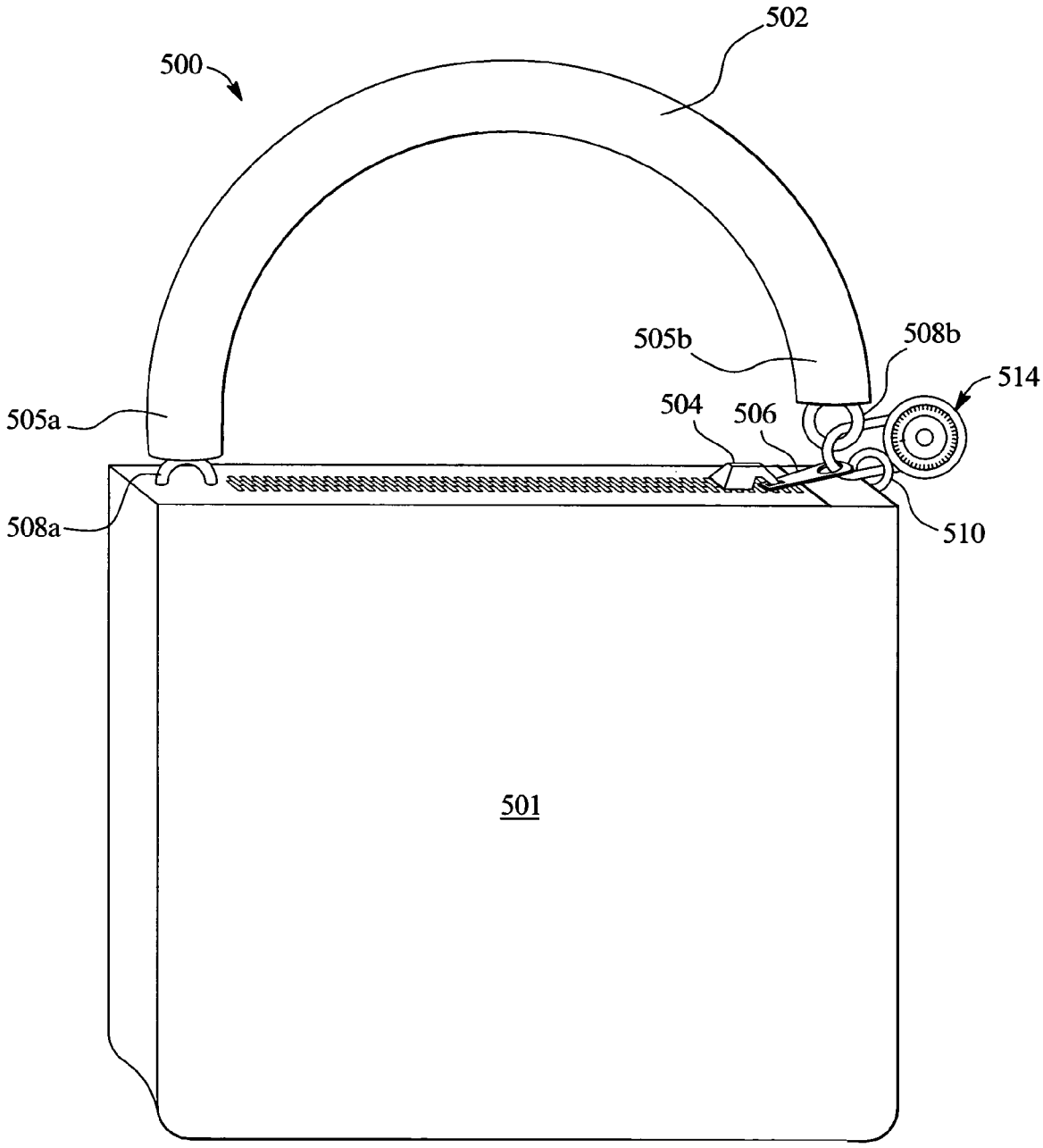
FIG. 10 illustrates a front perspective view of another embodiment of the bag of the present invention where a suitable padlock is attached to the removable end of the handle, the closing member and the body of the bag.

Referring now to FIG. 10, another embodiment of the present invention is illustrated which includes a bag 500 having a body 501 and a handle 502 connected to the body. The handle 502 includes a first end 505*a* and a second end 505*b*. Securing members or securing rings 508*a* and 508*b* are connected to each end of the handle 512. In this embodiment, one end 508*b* is removable from the body 501 to enable the end 505*b* to be secured about another item such as a chair. Specifically, the closing member or zipper 504 is pulled or moved until the tab 506 is positioned adjacent to the securing ring 508*b* at one end of the body 501. A lock ring 510 is connected to the body 501. The securing ring 508*b*, the tab 506 and the lock ring 510 are all positioned adjacent to each other so that a detachable lock such as the combination lock 514 may be used to secure the securing ring 508*b*, the tab 506 and the lock ring 510 together so that the bag may not be opened or the contents in the bag may not be removed. In particular, the U-shaped member 511 of the lock 514 is inserted through the securing ring 508*b*, the tab 506 and the lock ring 510 to hold these devices in place. The combination lock 514 is locked. To release these devices, the user sets or indicates the designated combination on the combination lock 514 which opens the lock and releases the securing ring 508*b*, the tab 506 and the lock ring 510. The securing ring 508*b* is then suitably secured or attached to the body 501 of the bag by attaching the securing ring 508*b* to the lock ring 510 or to any other suitable portion of the body 501. It should be appreciated that any suitable attachable lock such as a padlock may be used to secure the securing ring 508*b*, the tab 506 and the lock ring 510 together to lock and/or unlock the end 505*b* of the handle 502 to the body 501.

Figure 11A:
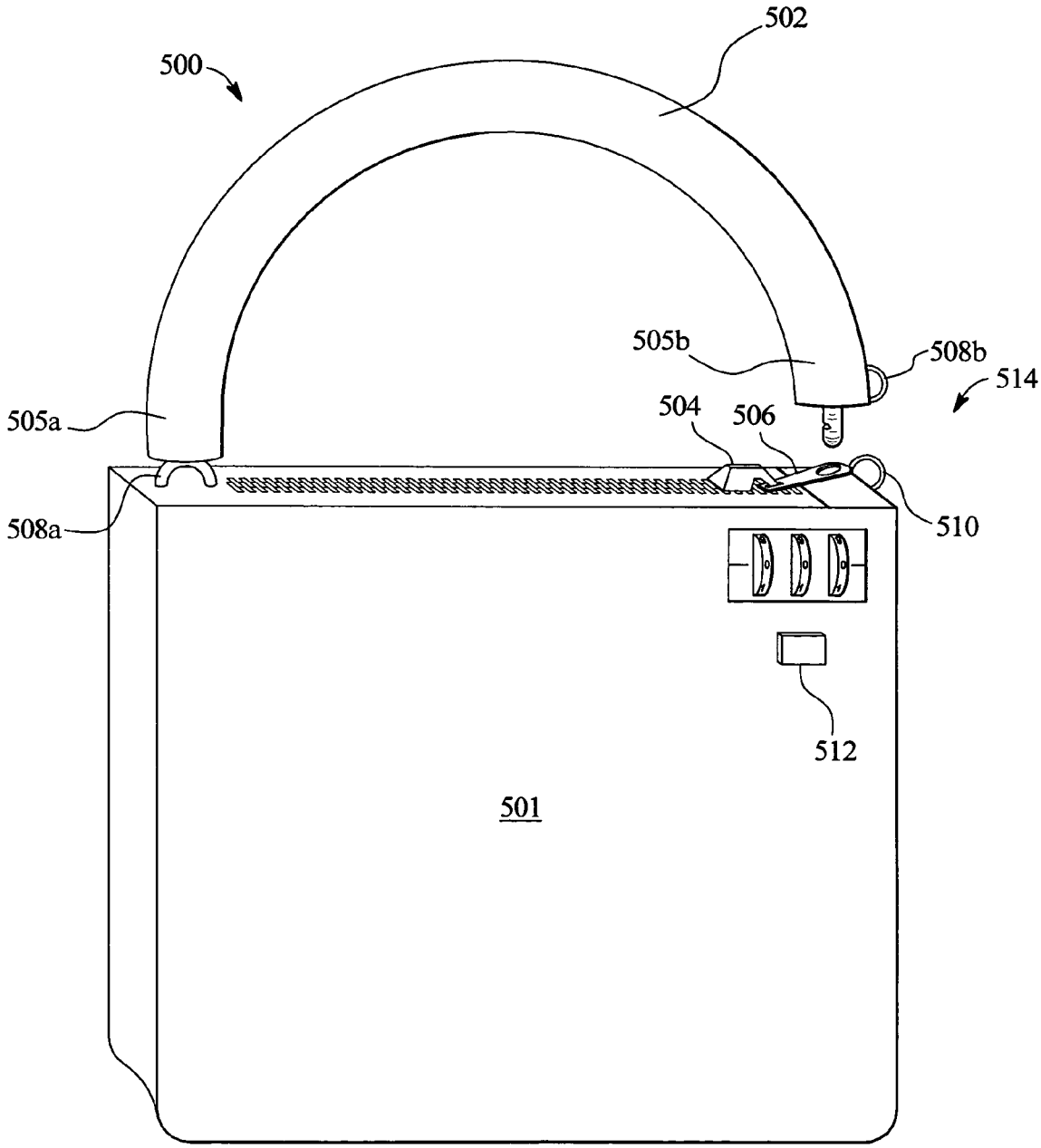
FIG. 11A illustrates a front perspective view of a further embodiment of the bag of the present invention including a combination lock and a padlock where the handle is not secured to the body of the bag.
Figure 11B:
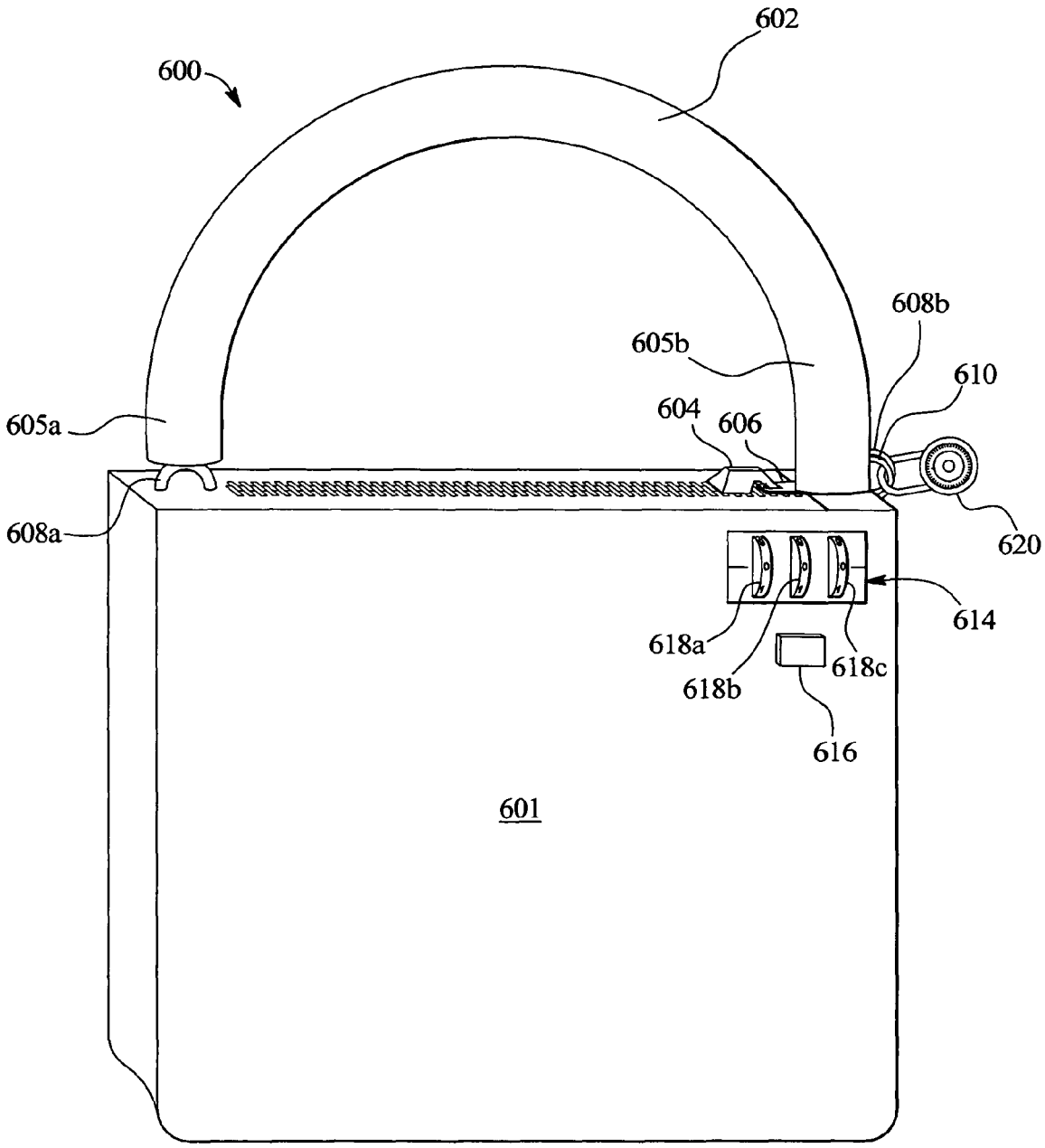
FIG. 11B illustrates a front perspective view of a further embodiment of the bag of the present invention including a combination lock and a padlock where the handle is secured to the body of the bag.

Referring now to FIGS. 11A and 11B, a further embodiment of the present invention which includes a bag 600 having a body 601 and a handle 602 connected to the body where the handle 602 is securable to the body using locking device or locking mechanism 614 and/or a suitable padlock 620. Specifically, the handle 602 includes a first end 605*a* and a second end 605*b*. Securing members or securing rings 608*a* and 608*b* are connected to each end of the handle 602. It should be appreciated that the bag 600 may include one or a plurality of securing rings. In this embodiment, one end 605*b* is removable from the body 601 to enable the end 605*b* to be secured about another item as described above. The closing member or zipper 604 is pulled or moved until the tab 606 is positioned adjacent to receptacle 612 defined by the body 601 as shown in FIG. 11A. A post 609, which is connected to the end 605*b* of the handle 602, is inserted through an opening defined by pull tab 606 of zipper 604 and into the receptacle 612 to secure the handle 602 and zipper in place as shown in FIG. 11B. A lever or tab 611 is moved or pressed to release the post 609 from the receptacle 612.

Once the post 609 is secured in the receptacle 612, the handle can be locked in place by using lock mechanism 614 and/or padlock 620. The lock mechanism 614 is a combination lock including three dials 618*a*, 618*b* and 618*c*. As described above, the dials each include indicia which are set to a designated release or unlocking combination to unlock the post 609. The designated combination may be any suitable combination. Alternatively, the handle 602 can be locked in place by using a suitable detachable lock such as padlock 620 as shown in FIG. 11B. Once securing ring 608*b*, tab 606 and lock ring 610 are all positioned adjacent to each other, combination lock 614 is inserted through each of these components as shown in FIG. 11B to secure the securing ring 608*b*, the tab 606 and the lock ring 610 together. As a result the handle 602 is locked in place. It should be appreciated that handle 602 and zipper 604 may be secured and locked in place using lock mechanism 614, padlock 620 or both the lock mechanism 614 and padlock 620.

Figure 12:
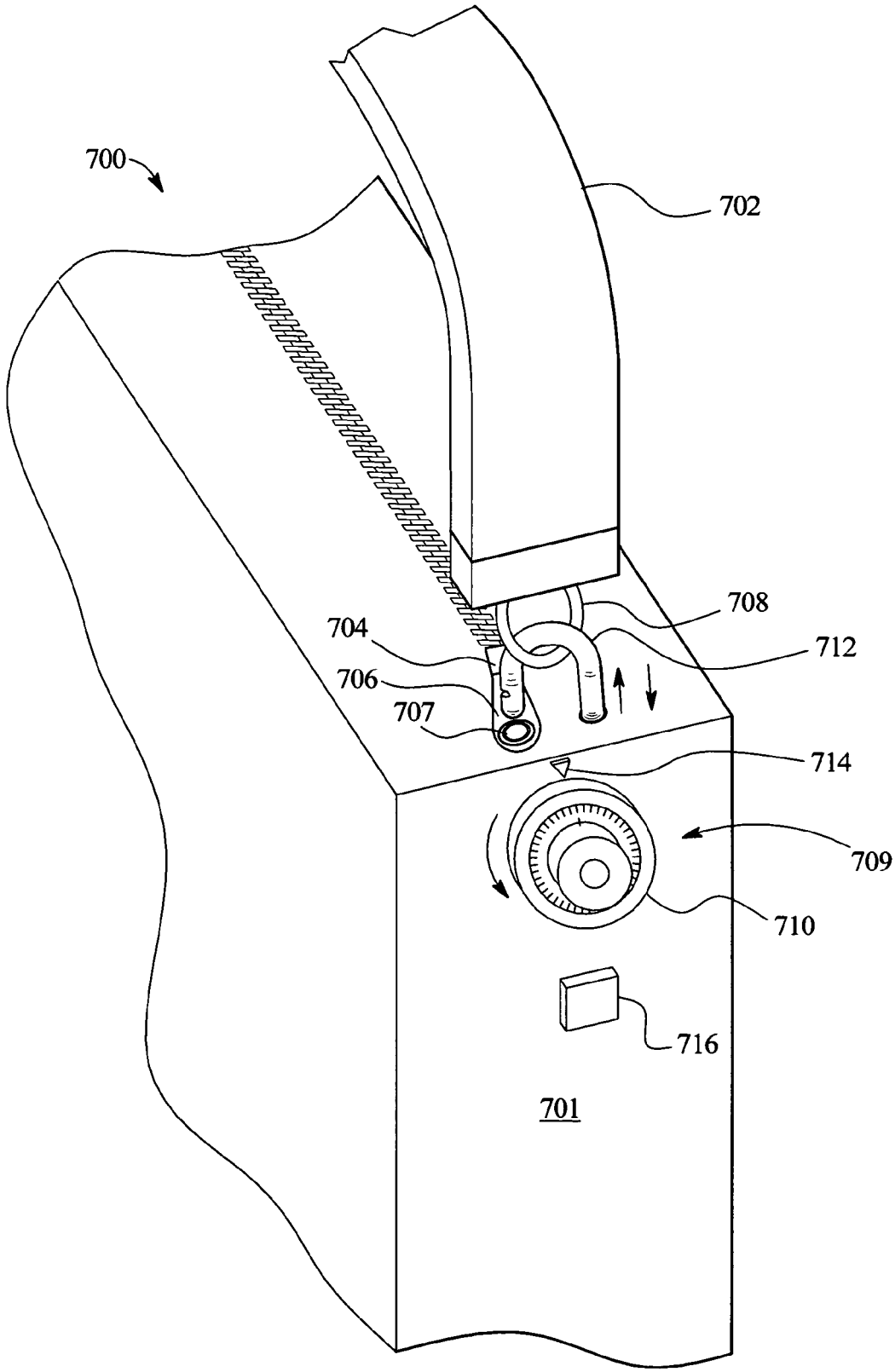
FIG. 12 illustrates a front perspective view of another embodiment of the bag of the present invention including a body having a combination lock which secures the handle to the body of the bag.

Referring now to FIG. 12, another embodiment of the present invention is directed to a bag 700 having a body 701 and a handle 702 connected to the body where the handle 702 is securable to the body using a padlock type lock 709 connected to the body 701. In this embodiment, the lock 709 includes a dial 710 having a plurality of indicia, where the dial is rotatably connected a side of the body 701. The lock also includes a curved securing member 712 movably connected to the top side or surface of the body. The handle 702 includes at least one ring 708 where the ring is connected to a removable end of the handle.

To secure and lock the handle to the body, the ring 708 is placed around the securing member 712. The securing member is then pushed or pressed downward through opening 707 defined in tab 706 of zipper 704 and into a receptacle (not shown) defined in the top side of the body and the zipper to secure the securing member, closing member or zipper and handle to the body. An indicator 714 indicates one or more of the indicia on the dial to manually set a combination associated with the lock to unlock and release the securing member 712 from the body 701. Therefore, to unlock the securing member, closing member and handle, a user turns or rotates the dial 710 to indicate the designated combination with indicator 714. Once the designated combination is indicated, the securing member is unlocked and the user pushes or presses release tab 716 to release the securing member, closing member and the handle from the body. It should be appreciated that any suitable combination lock may be used to secure and lock the closing member and the handle to the body of the bag.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A bag comprising:

a body defining an interior space and an opening;

a single closing member connected to the body, the closing member being movable to a first position to allow access to the interior space through the opening and to a second position to prevent access to the interior space through the opening, the closing member including a zipper having a plurality of opposing mating dividers connected to the body and a zipper pull movably connected to each of the plurality of mating dividers;

a rigid or substantially rigid carrying handle connected to the body, the handle including a removable end and a non-removable end, the non-removable end being slidably coupled to the body to enable the carrying handle as a whole to move between an open position and a closed position;

a securing member attached to the removable end of the carrying handle and insertable through an opening of the zipper pull and into a receptacle in the body; and a lock configured to secure the securing member when the handle is in the closed position.

2. The bag of claim 1, wherein the lock is a combination lock including a plurality of movable dials and a release tab.

3. The bag of claim 2, wherein the securing member is unlocked by moving the dials to a designated combination and moving the release tab.

* * * * *